US010918195B2

(12) United States Patent
Kooyers

(10) Patent No.: US 10,918,195 B2
(45) Date of Patent: Feb. 16, 2021

(54) UTILITY BELT ASSEMBLY

(71) Applicant: Dustin Kooyers, Grandville, MI (US)

(72) Inventor: Dustin Kooyers, Grandville, MI (US)

( * ) Notice: Subject to any disclaimer, the term of this patent is extended or adjusted under 35 U.S.C. 154(b) by 0 days.

(21) Appl. No.: 15/226,320

(22) Filed: Aug. 2, 2016

(65) Prior Publication Data

US 2016/0338478 A1 Nov. 24, 2016

Related U.S. Application Data

(63) Continuation of application No. 13/920,722, filed on Jun. 18, 2013, now Pat. No. 9,402,458.

(51) Int. Cl.
*A45F 5/02* (2006.01)
*A41F 1/00* (2006.01)

(52) U.S. Cl.
CPC ..... *A45F 5/021* (2013.01); *A41F 1/008* (2013.01); *A45F 2200/0516* (2013.01); *A45F 2200/0575* (2013.01); *A45F 2200/0591* (2013.01)

(58) Field of Classification Search
CPC ..... A45F 2200/0516; A45F 2200/0575; A45F 2200/0591
USPC ..... 224/660
See application file for complete search history.

(56) References Cited

U.S. PATENT DOCUMENTS 408,179 A 7/1889 Katzenberg
411,416 A 9/1889 Blakesley
439,375 A 10/1890 Blakesley
583,986 A 6/1897 Drost
603,760 A 5/1898 Gair
645,756 A 3/1900 Puellmann
653,779 A 7/1900 Phillips
814,599 A 3/1906 Freyer
837,156 A 11/1906 Townsend
881,044 A 3/1908 Audley
1,045,713 A 11/1912 Lewis
2,310,040 A 2/1913 Schneider
1,378,207 A * 5/1921 Awner ..... A41F 9/00 2/312
1,502,414 A * 7/1924 Washuk ..... A41F 9/00 2/300
1,618,147 A 2/1927 Carpenter
1,653,288 A 12/1927 Johnson
1,886,718 A 11/1932 Noel
(Continued)

*Primary Examiner* — Derek J Battisti
(74) *Attorney, Agent, or Firm* — King & Partners, PLC

(57) ABSTRACT

A utility belt assembly for use in association with an article of clothing including a belt member, wherein the belt member includes a first end, a second end, an inner surface, an outer surface, an upper end, and a lower end; a first bracket, wherein the first bracket is positioned on at least one of the inner surface and the outer surface of the belt member; a second bracket, wherein the second bracket is positioned on at least one of the inner surface and the outer surface of the belt member; wherein the first bracket and the second bracket are spaced apart from one another to define a first track therebetween; a securement member, wherein the securement member contacts at least one of the upper end and the lower end of the belt member, and wherein the securement member releasably associates the utility belt assembly with the article of clothing; and an accessory member, wherein the accessory member includes a guide member slidably positioned on and/or within the first track.

2 Claims, 11 Drawing Sheets

(56) References Cited

U.S. PATENT DOCUMENTS

| | | | | | |
|---|---|---|---|---|---|
| 1,887,780 | A | | 11/1932 | Noel | |
| 1,908,038 | A | | 5/1933 | MacKenzie | |
| 1,935,984 | A | | 11/1933 | Noel | |
| 2,149,550 | A | | 9/1939 | Richards et al. | |
| 2,342,210 | A | | 2/1944 | Murphey | |
| 2,465,536 | A | | 3/1949 | Hyman | |
| 2,495,029 | A | | 1/1950 | Spengler | |
| 2,498,685 | A | | 2/1950 | Hyman | |
| 2,586,457 | A | | 2/1952 | Epstein | |
| 2,617,989 | A | * | 11/1952 | Saul | A41F 11/14 2/323 |
| 2,655,707 | A | | 10/1953 | Rubin | |
| 2,725,573 | A | * | 12/1955 | Kornhauser | A41D 27/202 2/247 |
| 3,004,315 | A | | 10/1961 | Masure | |
| 3,168,972 | A | | 2/1965 | Parlante et al. | |
| 3,171,409 | A | | 3/1965 | Cetrone | |
| 3,210,820 | A | | 10/1965 | Humiston | |
| 3,250,448 | A | | 5/1966 | Clark | |
| 3,300,109 | A | | 1/1967 | Clark | |
| 3,441,185 | A | | 4/1969 | Moomaw | |
| 3,495,770 | A | | 2/1970 | Seltmann, Jr. | |
| 3,501,775 | A | | 3/1970 | Demers et al. | |
| 3,591,866 | A | | 7/1971 | Jensen | |
| 3,655,106 | A | | 4/1972 | Wojcinski | |
| 3,731,858 | A | | 5/1973 | Baker | |
| 3,866,276 | A | | 2/1975 | Perkins | |
| 3,902,639 | A | | 9/1975 | Rogers | |
| 3,904,091 | A | | 9/1975 | Jones | |
| 3,915,361 | A | | 10/1975 | Perkins | |
| D240,225 | S | | 6/1976 | Baker | |
| D251,758 | S | | 5/1979 | Penrod | |
| 4,253,592 | A | | 3/1981 | Anderson | |
| 4,303,187 | A | | 12/1981 | Berman | |
| D264,240 | S | | 5/1982 | Bianchi | |
| 4,341,331 | A | | 7/1982 | McDougall | |
| 4,342,410 | A | | 8/1982 | Sloan | |
| 4,356,943 | A | | 11/1982 | Berman | |
| 4,384,372 | A | | 5/1983 | Rector | |
| 4,408,706 | A | | 10/1983 | Hurley | |
| 4,424,924 | A | | 1/1984 | Perkins | |
| 4,463,455 | A | | 8/1984 | Kirk | |
| D276,476 | S | | 11/1984 | Johansson et al. | |
| 4,504,001 | A | | 3/1985 | Nichols | |
| 4,544,089 | A | | 10/1985 | Tabler | |
| 4,619,020 | A | | 10/1986 | Lecher, Sr. | |
| 4,644,676 | A | | 2/1987 | Stern | |
| 4,736,853 | A | | 4/1988 | O'Mara | |
| 4,747,527 | A | | 5/1988 | Trumpower, II | |
| 4,787,540 | A | | 11/1988 | Barry | |
| 4,796,790 | A | | 1/1989 | Hamilton | |
| 4,848,625 | A | | 7/1989 | Lucia | |
| 4,923,105 | A | | 5/1990 | Snyder | |
| 4,937,920 | A | | 7/1990 | Tsai | |
| 4,962,873 | A | | 10/1990 | Schattel | |
| D313,121 | S | | 12/1990 | Dise | |
| 4,993,614 | A | | 2/1991 | Bonofiglo | |
| 5,054,670 | A | | 10/1991 | Gallagher | |
| 5,100,036 | A | | 3/1992 | Rogers et al. | |
| 5,152,443 | A | | 10/1992 | Hagan | |
| 5,201,448 | A | | 4/1993 | Schue | |
| 5,265,781 | A | | 11/1993 | Nichols | |
| 5,349,706 | A | | 9/1994 | Keer | |
| 5,388,274 | A | | 2/1995 | Glover et al. | |
| 5,413,262 | A | | 5/1995 | Dewire et al. | |
| D361,658 | S | | 8/1995 | Martin | |
| 5,441,185 | A | | 8/1995 | Dragos | |
| 5,464,136 | A | | 11/1995 | Eddy | |
| 5,470,000 | A | | 11/1995 | Munoz | |
| 5,484,395 | A | | 1/1996 | DeRoche | |
| 5,497,923 | A | | 3/1996 | Pearson et al. | |
| 5,505,358 | A | | 4/1996 | Noriega et al. | |
| 5,511,703 | A | | 4/1996 | Ryerson | |
| 5,551,496 | A | | 9/1996 | Gray, Jr. | |
| 5,568,889 | A | | 10/1996 | Holloway, Jr. et al. | |
| D378,633 | S | | 4/1997 | Granito | |
| 5,653,337 | A | | 8/1997 | Cirigliano | |
| 5,683,022 | A | | 11/1997 | Evans | |
| 5,693,006 | A | | 12/1997 | Slautterback | |
| 5,894,976 | A | | 4/1999 | Harper | |
| D410,773 | S | | 6/1999 | Case | |
| 5,941,438 | A | | 8/1999 | Price | |
| 5,964,386 | A | | 10/1999 | Cote | |
| 6,119,909 | A | | 9/2000 | Dancyger | |
| 6,179,185 | B1 | | 1/2001 | Dancyger | |
| 6,213,365 | B1 | | 4/2001 | Stocke et al. | |
| 6,244,485 | B1 | | 6/2001 | Holland et al. | |
| 6,398,092 | B1 | | 6/2002 | Ansley | |
| 6,446,852 | B1 | | 9/2002 | Sorensen et al. | |
| 6,610,032 | B1 | * | 8/2003 | Prody | A61M 27/00 604/179 |
| 7,165,706 | B2 | * | 1/2007 | Barr | A45C 7/009 224/661 |
| D588,802 | S | | 3/2009 | Cicione | |
| 7,526,842 | B2 | * | 5/2009 | Wemmer | A41D 27/20 24/3.7 |
| 7,900,278 | B2 | * | 3/2011 | Pittman | A45F 3/14 2/310 |
| 2003/0110550 | A1 | * | 6/2003 | Guibord | A41F 9/002 2/312 |
| 2005/0015944 | A1 | * | 1/2005 | Bergeron | A45F 5/02 24/584.1 |
| 2009/0151053 | A1 | * | 6/2009 | Belouin | A44B 6/00 2/319 |
| 2010/0025560 | A1 | * | 2/2010 | Beck | A45F 5/02 248/558 |
| 2011/0240705 | A1 | | 10/2011 | Landano | |
| 2013/0043286 | A1 | * | 2/2013 | Kast | A45F 5/02 224/191 |

* cited by examiner

UTILITY BELT ASSEMBLY

CROSS-REFERENCE TO RELATED APPLICATIONS

This application is a continuation of U.S. application Ser. No. 13/920,722, filed Jun. 18, 2013, entitled "Utility Belt Assembly" which is hereby incorporated herein by reference in its entirety, including all references cited therein.

BACKGROUND OF THE INVENTION

1. Field of the Invention

The present invention relates in general to a utility belt assembly and, more particularly, to a utility belt assembly which facilities non-impaired and/or essentially infinitely variable positioning of accessory items (e.g., a holster for a handgun, an ammunition magazine, a flashlight, a communication device such as a cellular phone and/or two-way radio, tools, etcetera) associated therewith. The utility belt assembly of the present invention is also releasably securable to an article of clothing (e.g., pants, fatigues, capris, shorts, skirts, etcetera) without the use of belt loops.

2. Background Art

Various types of utility belts and associated accessory items have been known in the art for years, and are the subject of a plurality of publications and patents, including, for example: United States Patent Application Publication Number 2011/0240705 entitled "Ergonomic Rotatable Apparatus and Method for Use Thereof to Carry and Store Equipment and Accessories," U.S. Pat. No. 6,446,852 entitled "Belt Assembly for Storage and Inventory of Tools," U.S. Pat. No. 6,398,092 entitled "Carpenter's Belt with Lumbosacral Support, Looped Interchangeable Pouches, and Snaps for Suspenders," U.S. Pat. No. 5,265,781 entitled "Belt or Waistband Mountable Support for Article Carrier," U.S. Pat. No. 4,787,540 entitled "Hand Gun Holster Selectably Configured and to be Placed on a Belt," U.S. Pat. No. 4,463,455 entitled "Two Part Adjustable Belt with Locking Means," U.S. Pat. No. 4,342,410 entitled "Combination Hand Gun Holster and Belt," and U.S. Pat. No. 3,655,106 entitled "Gunbelt"—all of which are hereby incorporated herein by reference in their entirety including all references cited therein.

United States Patent Application Publication Number 2011/0240705 appears to disclose an ergonomic rotatable apparatus for carrying, storing and accessing accessories and field gear comprising a layered belt rail system and field gear pockets supported thereon.

U.S. Pat. No. 6,446,852 appears to disclose a tool-carrying assembly to be secured by a waist-encircling belt, and, additionally, by straps encircling the legs of a workman using the belt assembly. The assembly is thus stabilized, and enhanced weight distribution is achieved. Elements of the belt assembly include a waist-encircling band supporting a pair of laterally spaced, depending panels each carrying tool-accepting pockets. The pockets carry visual markings and coding as well as other indicia identifying the specific tools to be "housed" or carried in and to be returned to each pocket after use. Inventory control of the tools is thereby enhanced. Pivotal flaps depending from the band-carried panels serve to cover the tools when not in use, and to prevent the tools from scratching or otherwise marring any article, fixture, or "workpiece" requiring the workman's attention. The panels and the tools carried thereby are disposed in lateral, spaced zones at the wearer's sides (and not directly in the front of one's body) thus further to reduce any likelihood of the tools coming into damaging physical contact with an article being worked upon. That is, both frontal and rearwardly located zones about the wearer of the tool belt assembly are rendered essentially free and clear of all tools and other mechanical impediments. While wearing the tool assembly of the invention, a worker can, without any discomfort, lie upon and use a "creeper." A frontal sector of the belt itself is covered with a relatively soft, non-marring protective pad, composition, or surface material effective to prevent possible damage from a workman's belt buckle. An additional feature of the invention is that the panels may be structured to constitute a core sandwiched between a pair of encasing sheet-like webs. The resulting composite is readily formable to provide selectable visual patterns, designs or indicia, for example, to identify product name or sources and/or to constitute decorations.

U.S. Pat. No. 6,398,092 appears to disclose a rigid carpenter's belt with lumbosacral support that includes end sections to accept a plurality of interchangeable looped carpenter pouches with Velcro strips to attach the pouches to corresponding Velcro strips on the carpenter belt. The belt comprises a belt structure of leather having a buckle on one end and holes in the other end to form a releasable coupling and a central section of increased height, cephalad and caudoly, to provide lumbosacral support extending laterally within the central section and fabricated of foamlike material covered with split leather. Laterally disposed on opposite sides of the lumbosacral support.

U.S. Pat. No. 5,265,781 appears to disclose a mounting device for suspending a holster or other article carrier from a wearer's waistband or belt which is a U-shaped paddle member in one version for hooking over a wearer's waistband, and a plate with slots for receiving a belt in another version. Both the plate and one leg of the paddle member are provided with a pivot opening for receiving a first, pivotal fastener for pivotally connecting the devices to a holster, and a pair of arcuate slots positioned symmetrically one on each side of the pivot opening for receiving a pair of releasable fasteners for securing the holster in a selected angular position. The other leg of the paddle member is of arrowhead-like shape with its free end slightly pointed for easy insertion into the waistband, and a pair of inwardly directed barbs for fitting under the waistband to resist inadvertent pulling up and dislodging of the member. The plate can be rotated 180 degrees when the releasable fasteners are removed between a high ride and a low ride position.

U.S. Pat. No. 4,787,540 appears to disclose a hand gun holster to operationally hold a thirty eight revolver, an automatic pistol or another hand gun, that has a pair of belt loops made of polypropylene medium weight webbing in turn positioned and supported by a pair of curvable assemblies of heavy weight nylon webbing having sewn thereon respectively and cooperatively spaced heavy duty nap, (i.e., loop and hook fastening materials), with these pair of curvable assemblies being arranged in alignment to receive and to hold an automatic pistol, and being arranged perpendicularly to receive and to hold a thirty eight revolver.

U.S. Pat. No. 4,463,455 appears to disclose an adjustable two-part belt with locking means comprising elongated belt members which overlap each other and transverse members connected to the ends of the overlapping portions of the belt members and at least partially encircling the corresponding portions of the belt members. At least one of the transverse members includes a clamp means in the form of a metallic strip which encircles at least a portion of the overlapping belt members and which is bendable to clamp the overlapping portions of the belt members against each other to maintain the length adjustment of the belt. The metallic strip means is preferably in a C-shape.

U.S. Pat. No. 4,342,410 appears to disclose a combination handgun holster and belt. The combination comprises a holster having inner and outer side panels that assist in forming a tapering configuration for conformably receiving a handgun. The holster has an open end for insertion and withdrawal therethrough of the gun. The belt is attached to the inner side panel of the holster and suspends the holster on one side of the waist of a person. A retaining member is provided having first and second ends. The member is attached at the first end to the outer side panel of the open end of the holster. A means is provided for detachably mounting the second end of the retaining member to the belt. Thus when the retaining member is mounted to the belt the handgun is safely retained in the holster and cannot be withdrawn therefrom. A release means is provided which is attached to the belt for automatically detaching the retaining member from the belt. The release means is adapted to be activated by the hand opposite the side from which the holster is suspended. Thus when the retaining member is released from the belt the gun can be withdrawn from the holster. Such a combination holster and belt prevents the accidental removal of the gun from the holster, (e.g., in a chase, etcetera), or the removal of the gun from the holster by a person other than the person wearing the holster.

U.S. Pat. No. 3,655,106 appears to disclose a detachable holding device for an implement, particularly a weapon, to be carried, in diagonal position, by means of a sling arrangement, on the upper body, with at least one strap shackle, or the like, to which the holding device is attached, characterized by a preferably plate-shaped part, onto which a locking member made, preferably, of flexible material, may be slid on, which serves to maintain the part in the inserted position on the strap shackle, and provided with a flange which does not pass through the strap shackle, to which is connected a suspending member which, with the suspending of the implement, serves to engage into a fastening device provided on the sling arrangement.

While the above-identified publications and patents do appear to disclose various types of utility belt assemblies, their configurations remain problematic for a plurality or reasons, including, but not limited to, limited positioning of accessory items and limited adaptability and/or securement to an article of clothing—among other things.

It is therefore an object of the present invention to provide a utility belt assembly that, among other things, remedies the aforementioned detriments and/or complications associated with the use of the above-identified, utility belt assemblies and associated accessories and articles of clothing.

These and other objects of the present invention will become apparent in light of the present specification, claims, and appended drawings.

SUMMARY OF THE INVENTION

In one embodiment, the present invention is directed to a utility belt assembly for use in association with an article of clothing comprising, consisting essentially of, and/or consisting of: (a) a belt member, wherein the belt member includes a first end, a second end, an inner surface, an outer surface, an upper end, and a lower end; (b) a first bracket, wherein the first bracket is positioned on at least one of the inner surface and the outer surface of the belt member; (c) a second bracket, wherein the second bracket is positioned on at least one of the inner surface and the outer surface of the belt member; (d) wherein the first bracket and the second bracket are spaced apart from one another to define a first track therebetween; (e) a securement member, wherein the securement member contacts at least one of the upper end and the lower end of the belt member, and wherein the securement member releasably associates the utility belt assembly with the article of clothing; and (f) an accessory member, wherein the accessory member includes a guide member slidably positioned on and/or within the first track.

In a preferred embodiment of the present invention, the belt member further comprises a buckle positioned proximate the first end thereof and apertures or holes positioned proximate the second end, to, in turn, form a releasable coupling.

In another preferred embodiment of the present invention, the first bracket is positioned on the inner surface of the belt member proximate the upper end thereof and the second bracket is positioned on the inner surface of the belt member proximate the lower end thereof, wherein the first bracket and the second bracket are spaced apart from one another to define a first track therebetween.

In yet another preferred embodiment of the present invention, the first bracket is positioned on the outer surface of the belt member proximate the upper end thereof and the second bracket is positioned on the outer surface of the belt member proximate the lower end thereof, wherein the first bracket and the second bracket are spaced apart from one another to define a first track therebetween.

In another aspect of the present invention, the first bracket is positioned on the inner surface of the belt member proximate the upper end thereof and the second bracket is positioned on the inner surface of the belt member proximate the lower end thereof, wherein the first bracket and the second bracket are spaced apart from one another to define a first track therebetween, and wherein the utility belt further comprises a third bracket positioned on the outer surface of the belt member proximate the upper end thereof and a fourth bracket positioned on the outer surface of the belt member proximate the lower end thereof, wherein the third bracket and the fourth bracket are spaced apart from one another to define a second track therebetween.

In a preferred embodiment of the present invention, the first bracket is positioned on the inner surface of the belt member proximate the upper end thereof and the second bracket is positioned on the inner surface of the belt member proximate a midpoint thereof, wherein the first bracket and the second bracket are spaced apart from one another to define a first track therebetween, wherein the utility belt further comprises a third bracket positioned on the inner surface of the belt member proximate the lower end thereof and a fourth bracket positioned on the inner surface of the belt member proximate the midpoint thereof, wherein the third bracket and the fourth bracket are spaced apart from one another to define a second track therebetween.

In another preferred embodiment of the present invention, the first bracket is positioned on the outer surface of the belt member proximate the upper end thereof and the second bracket is positioned on the outer surface of the belt member proximate a midpoint thereof, wherein the first bracket and the second bracket are spaced apart from one another to define a first track therebetween, and wherein the utility belt further comprises a third bracket positioned on the outer surface of the belt member proximate the lower end thereof and a fourth bracket positioned on the outer surface of the belt member proximate the midpoint thereof, and wherein the third bracket and the fourth bracket are spaced apart from one another to define a second track therebetween.

In yet another preferred embodiment of the present invention, in addition to the brackets identified supra, the utility belt assembly further comprises a fifth bracket positioned on the inner surface of the belt member proximate the upper end thereof and a sixth bracket positioned on the inner surface of the belt member proximate a midpoint thereof, wherein the fifth bracket and the sixth bracket are spaced apart from one another to define a third track therebetween, and wherein the utility belt yet further comprises a seventh bracket positioned on the inner surface of the belt member proximate the lower end thereof and an eighth bracket positioned on the inner surface of the belt member proximate the midpoint thereof, wherein the seventh bracket and the eighth bracket are spaced apart from one another to define a fourth track therebetween.

In a preferred embodiment of the present invention, the first bracket, the second bracket, the third bracket, the fourth bracket, the fifth bracket, the sixth bracket, the seventh bracket and/or the eighth bracket comprise substantially L-shaped brackets.

Preferably, one or more brackets comprise a stop tab for regulating displacement of the accessory member.

In yet another preferred embodiment of the present invention, the securement member contacts the upper end or the lower end of the belt member.

In another aspect of the invention, the first track extends from approximately the first end to approximately the second end of the belt member.

In a preferred embodiment of the present invention, the securement member comprises a zipper and/or loop and hook fastener secured to the article of clothing.

In another preferred embodiment of the present invention, the article of clothing consists of a pair of pants.

In yet another preferred embodiment of the present invention, the guide member is releasably associated with the accessory member (e.g., a holster).

In a preferred embodiment of the present invention, the utility belt further comprises conductive traces that facilitate the provision of electricity to and/or throughout the utility belt assembly.

In one embodiment, the present invention is also directed to a utility belt assembly in combination with an article of clothing, comprising, consisting essentially of, and/or consisting of: (a) an article of clothing adorned by a human; (b) a belt member, wherein the belt member includes a first end, a second end, an inner surface, an outer surface, an upper end, and a lower end; (c) a first bracket, wherein the first bracket is positioned on at least one of the inner surface and the outer surface of the belt member proximate the upper end thereof; (d) a second bracket, wherein the second bracket is positioned on at least one of the inner surface and the outer surface of the belt member proximate the lower end thereof; (e) wherein the first bracket and the second bracket are spaced apart from one another to define a first track therebetween; (f) a securement member, wherein the securement member contacts at least one of the upper end and the lower end of the belt member, and wherein the securement member is releasably associated with the article of clothing; and (g) an accessory member, wherein the accessory member includes a guide member slidably positioned on and/or within the first track.

In one embodiment, the present invention is further directed to a utility belt assembly for use in association with an article of clothing, consisting of: (a) a belt member, wherein the belt member includes a first end, a second end, an inner surface, an outer surface, an upper end, and a lower end; (b) a first bracket, wherein the first bracket is positioned on the inner surface of the belt member proximate the upper end thereof; (c) a second bracket, wherein the second bracket is positioned on the inner surface of the belt member proximate the lower end thereof; (d) wherein the first bracket and the second bracket are spaced apart from one another to define a track therebetween; (e) a securement member, wherein the securement member contacts the lower end of the belt member, and wherein the securement member releasably associates the utility belt assembly with the article of clothing; and (f) an accessory member, wherein the accessory member includes a guide member slidably positioned on and/or within the first track.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive have been omitted. It will be further understood that the invention is not necessarily limited to the particular embodiments illustrated herein.

The invention will now be described with reference to the drawings wherein.

DETAILED DESCRIPTION OF THE INVENTION

Figure 1:
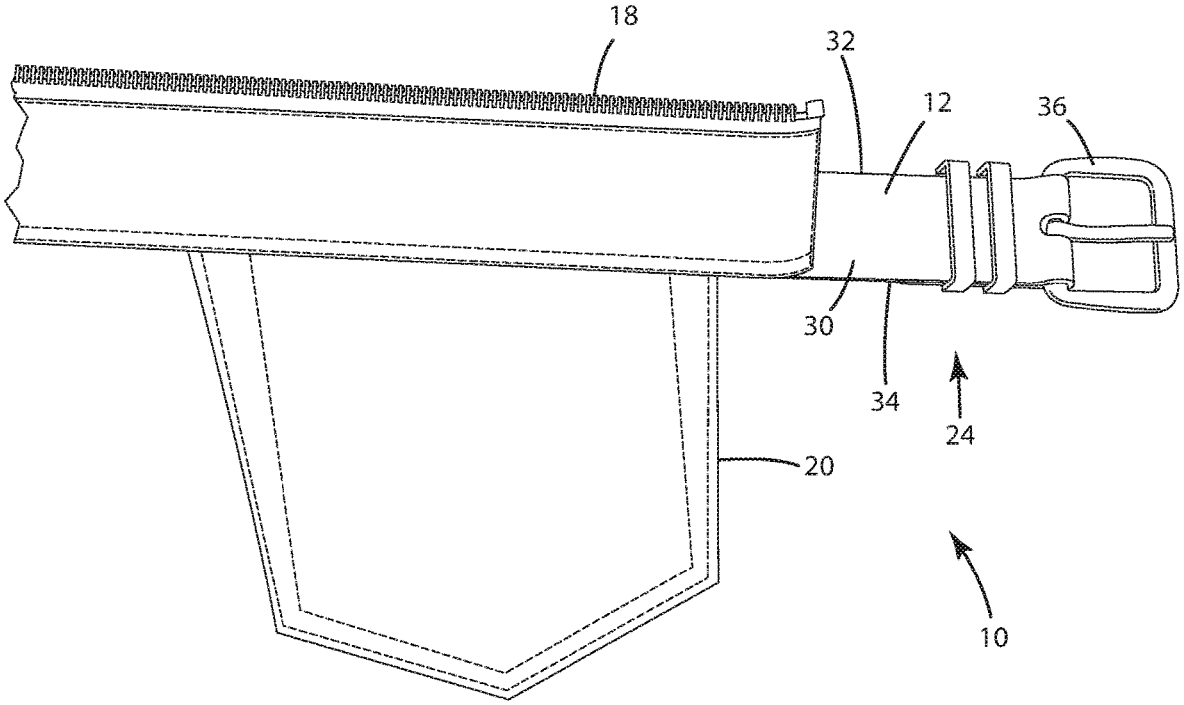
FIG. 1 of the drawings is a fragmented perspective view of a utility belt assembly, fabricated in accordance with the present invention, showing the outside of the first end thereof.
Figure 2:
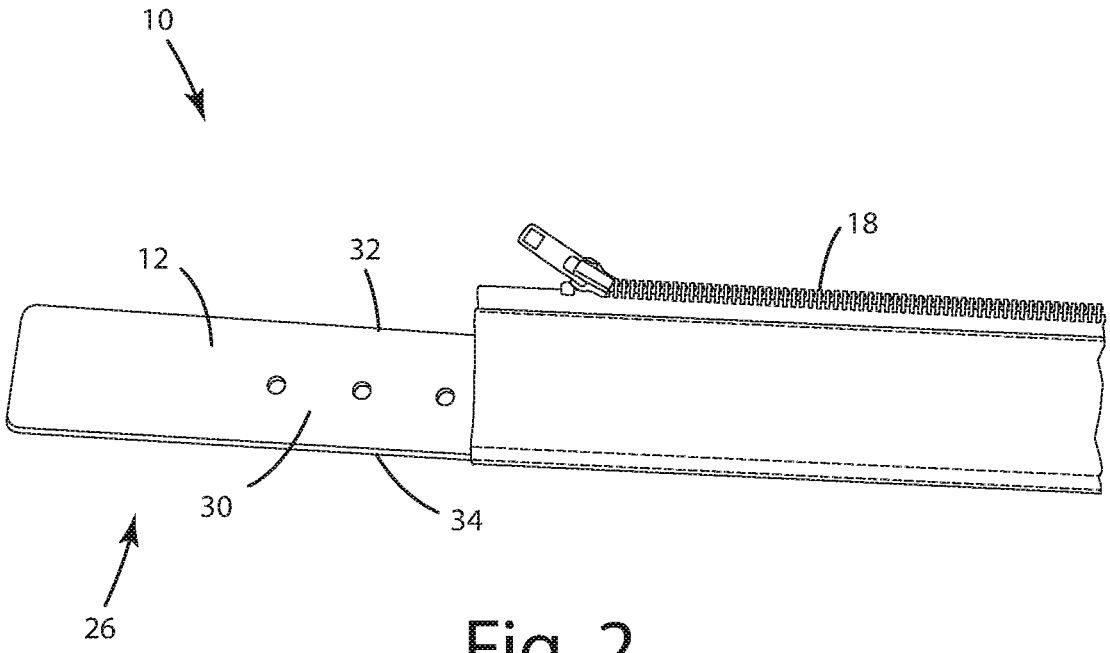
FIG. 2 of the drawings is a fragmented perspective view of a utility belt assembly, fabricated in accordance with the present invention, showing the outside of the second end thereof.
Figure 3:
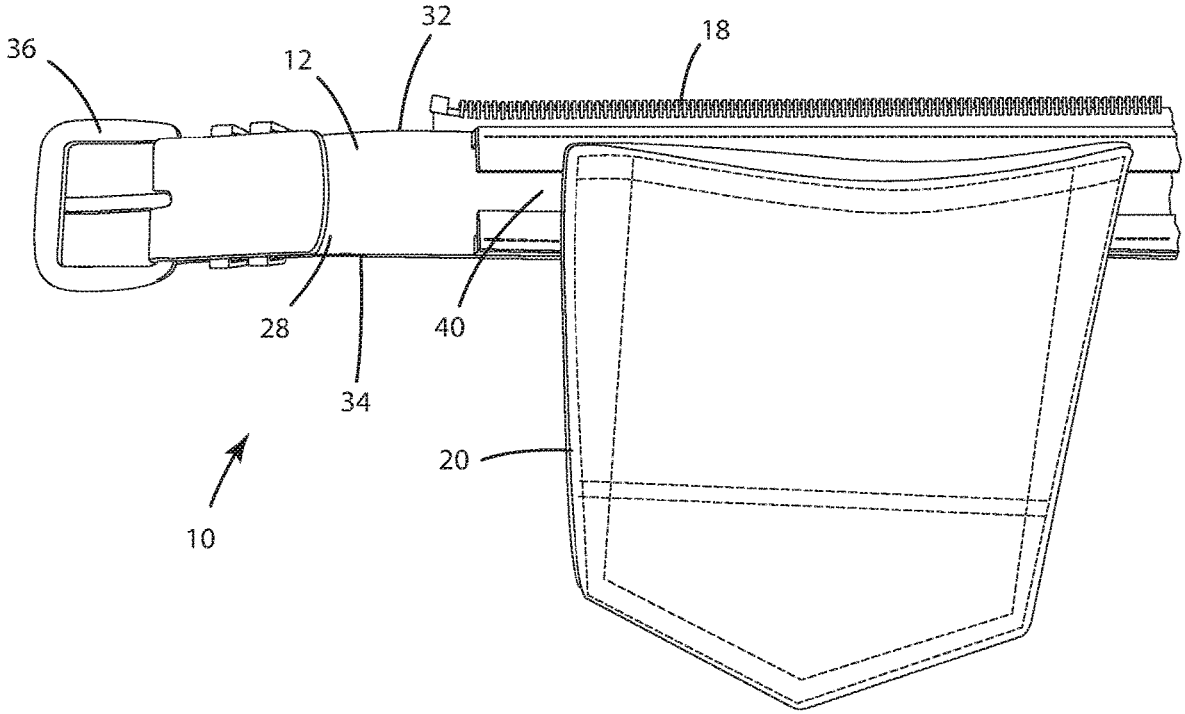
FIG. 3 of the drawings is a fragmented perspective view of a utility belt assembly, fabricated in accordance with the present invention, showing the inside of the first end thereof.
Figure 4:
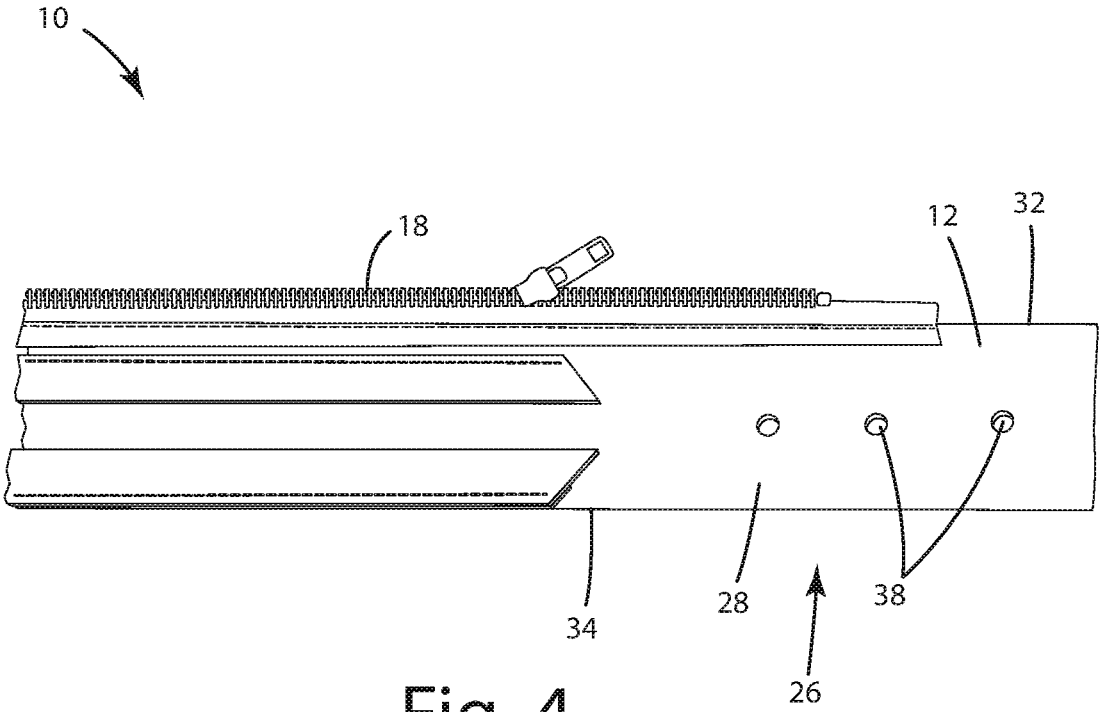
FIG. 4 of the drawings is a fragmented perspective view of a utility belt assembly, fabricated in accordance with the present invention, showing the inside of the second end thereof.
Figure 5:
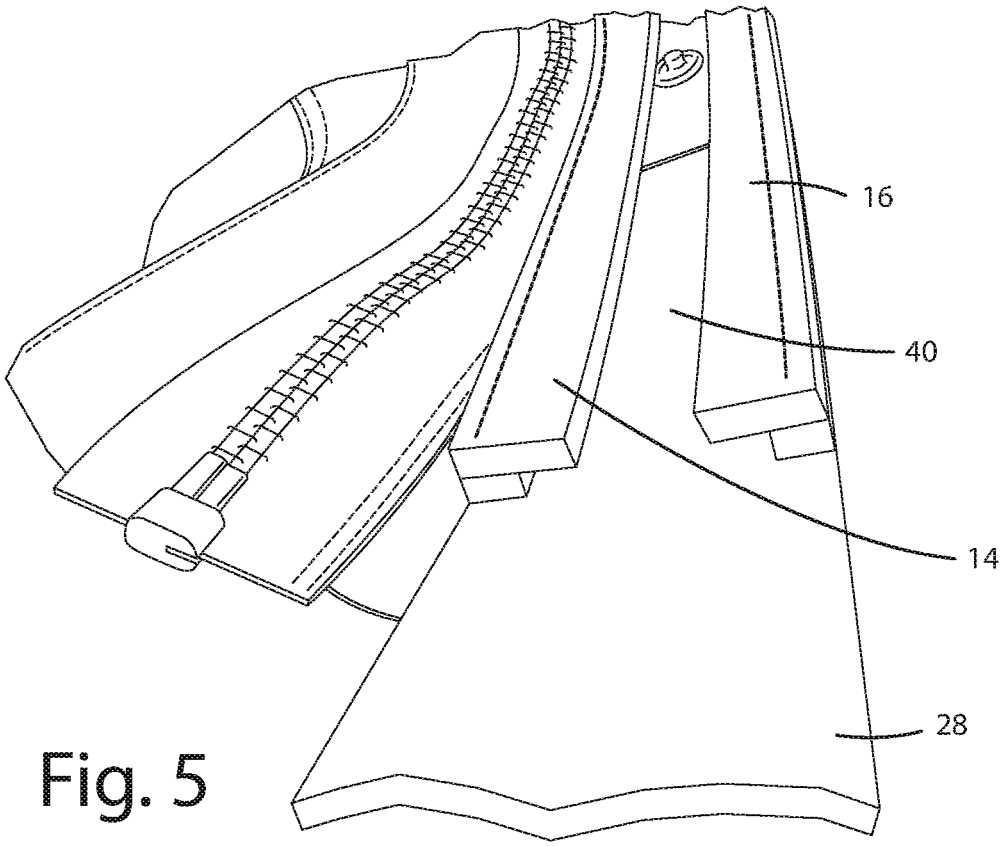
FIG. 5 of the drawings is a fragmented perspective view of a utility belt assembly, fabricated in accordance with the present invention, showing the track, guide member, and securement member.

While this invention is susceptible of embodiment in many different forms, there are shown in the drawings, and will herein be described in detail, several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings with like reference characters.

Referring now to the drawings, and to FIGS. 1-5 collectively, a first embodiment of utility belt assembly 10 is shown that generally comprises belt member 12, first bracket 14, second bracket 16, securement member 18, and accessory member 20. It will be understood that utility belt assembly 10 facilities non-impaired and/or essentially infinitely variable positioning of accessory member 20 (e.g., a holster for a handgun, an ammunition magazine, a flashlight, a communication device such as a cellular phone and/or two-way radio, tools, etcetera) releasably secured thereto compared to a conventional belt and looped article of clothing configurations. Utility belt assembly 10 is also advantageously releasably securable to article of clothing 22 (FIGS. 6, and 9-10; e.g., pants, fatigues, capris, shorts, skirts, etcetera) without the use of belt loops. For purposes of the present invention, utility belt assembly 10 may be associated with, for example, the waist, arm, leg, shoulder, chest, and/or torso of an associated user. It will be further understood that FIGS. 1-11 provided herein are merely representations of utility belt assembly 10. As such, some of the components may be distorted from their actual scale for pictorial clarity and/or image enhancement.

Referring now to FIGS. 1-4 collectively, in one embodiment, belt member 12 includes first end 24, second end 26, inner surface 28, outer surface 30, upper end 32, and lower end 34. Belt member 12 also preferably includes buckle 36 which is preferably positioned proximate first end 24, and one or more apertures 38 which are preferably positioned proximate second end 26 to, in turn, form a releasable coupling. Belt member 12 is preferably fabricated from leather, plastics, rubbers, natural and/or synthetic materials, and composites of the same—just to name a few.

As is best shown in FIGS. 4, 5, 7 and 11, in one embodiment, first bracket 14 is positioned on inner surface 28 and/or outer surface 30 (See FIG. 1) of belt member 12. First bracket 14 preferably comprises a substantially L-shaped bracket. However, other bracket configurations that would be known to those with ordinary skill in the art having the present disclosure before them are likewise contemplated for use. First bracket 14 is preferably fabricated from metals, woods, natural and/or synthetic materials, and composites of the same—just to name a few.

Second bracket 16 is positioned on inner surface 28 and/or outer surface 30 (See FIG. 1) of belt member 12. Second bracket 16 preferably comprises a substantially L-shaped bracket. However, other bracket configurations that would be known to those with ordinary skill in the art having the present disclosure before them are likewise contemplated for use. Similarly to first bracket 14, second bracket 16 is preferably fabricated from metals, woods, natural and/or synthetic materials, and composites of the same—just to name a few.

As is best shown in FIGS. 4, 5, 7, and 11A, in one embodiment, first bracket 14 and second bracket 16 are spaced apart from one another to define first track 40 therebetween.

As is best shown in FIGS. 1-4, 5, 7, and 11A, in a preferred embodiment of the present invention, first bracket 14 is positioned on inner surface 28 of belt member 12 proximate upper end 32 and second bracket 16 is positioned on inner surface 28 of belt member 12 proximate lower end 34. First track 40 is positioned between first bracket 14 and second bracket 16.

Figure 11A:
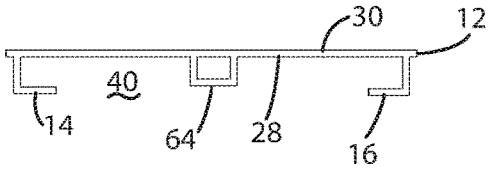
FIGS. 11A-11F of the drawings are cross-sectional views of utility belt assemblies, fabricated in accordance with the present invention, showing a plurality of bracket configurations.
Figure 11B:
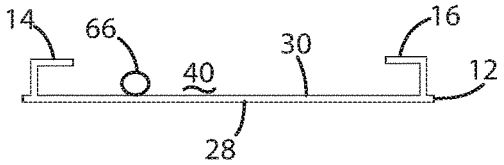
Figure 11C:
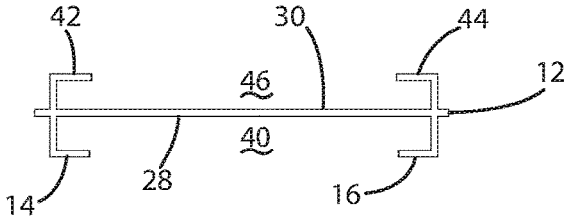

Referring now to FIG. 11B, in another single track configuration, first bracket 14 is positioned on outer surface 30 of belt member 12 proximate upper end 32 and second bracket 16 is positioned on outer surface 30 of belt member 12 proximate lower end 34. First track 40 is positioned between first bracket 14 and second bracket 16.

As is shown in FIG. 110, in a dual track configuration, first bracket 14 is positioned on inner surface 28 of belt member 12 proximate upper end 32 and second bracket 16 is positioned on inner surface 28 of belt member 12 proximate lower end 34. Third bracket 42 is positioned on outer surface 30 of belt member 12 proximate upper end 32 and fourth bracket 44 is positioned on the outer surface 30 of belt member 12 proximate lower end 34. First bracket 14 and second bracket 16 are spaced apart from one another to define first track 40 therebetween, and third bracket 42 and fourth bracket 44 are spaced apart from one another to define second track 46.

Figure 11D:
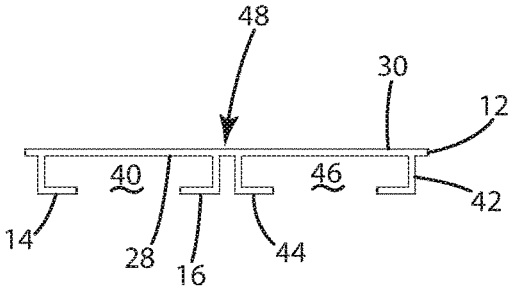

Referring now to FIG. 11D, in another dual track configuration, first bracket 14 is positioned on inner surface 28 of belt member 12 proximate upper end 32 and second bracket 16 is positioned on inner surface 28 of belt member 12 proximate midpoint 48. Third bracket 42 is positioned on inner surface 28 of belt member 12 proximate lower end 34, and fourth bracket 44 is positioned on inner surface 28 of belt member 12 proximate midpoint 48. First bracket 14 and second bracket 16 are spaced apart from one another to define 40 first track therebetween, and third bracket 42 and fourth bracket 44 are spaced apart from one another to define second track 46 therebetween.

Figure 11E:
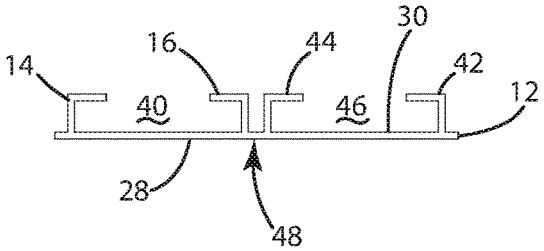

Referring now to FIG. 11E, in yet another dual track configuration, first bracket 14 is positioned on outer surface 30 of belt member 12 proximate upper end 32 and second bracket 16 is positioned on outer surface 30 of belt member 12 proximate midpoint 48. Third bracket 42 is positioned on outer surface 30 of belt member 12 proximate lower end 34 and fourth bracket 44 is positioned on outer surface 30 of belt member 12 proximate midpoint 48. First bracket 14 and second bracket 16 are spaced apart from one another to define 40 first track therebetween, and third bracket 42 and fourth bracket 44 are spaced apart from one another to define second track 46 therebetween.

Figure 11F:
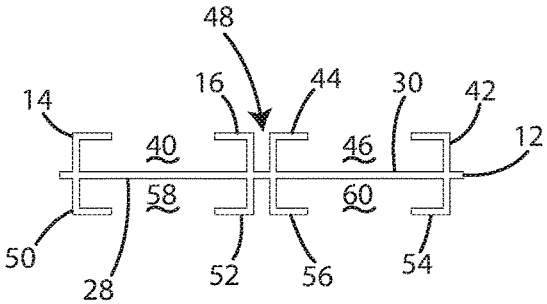

Referring now to FIG. 11F, in a quad track configuration, belt member 12, in addition to brackets 1-4 identified in FIG. 11E, also includes fifth bracket 50 positioned on inner surface 28 proximate upper end 32, sixth bracket 52 positioned on inner surface 28 of belt member 12 proximate midpoint 48, seventh bracket 54 positioned on inner surface 28 of belt member 12 proximate lower end 34, and eighth bracket 56 positioned on inner surface 28 of belt member 12 proximate midpoint thereof 48. Fifth bracket 50 and sixth bracket 52 are spaced apart from one another to define third track 58, and seventh bracket 54 and eighth bracket 56 are spaced apart from one another to define fourth track 60 therebetween.

Figure 6:
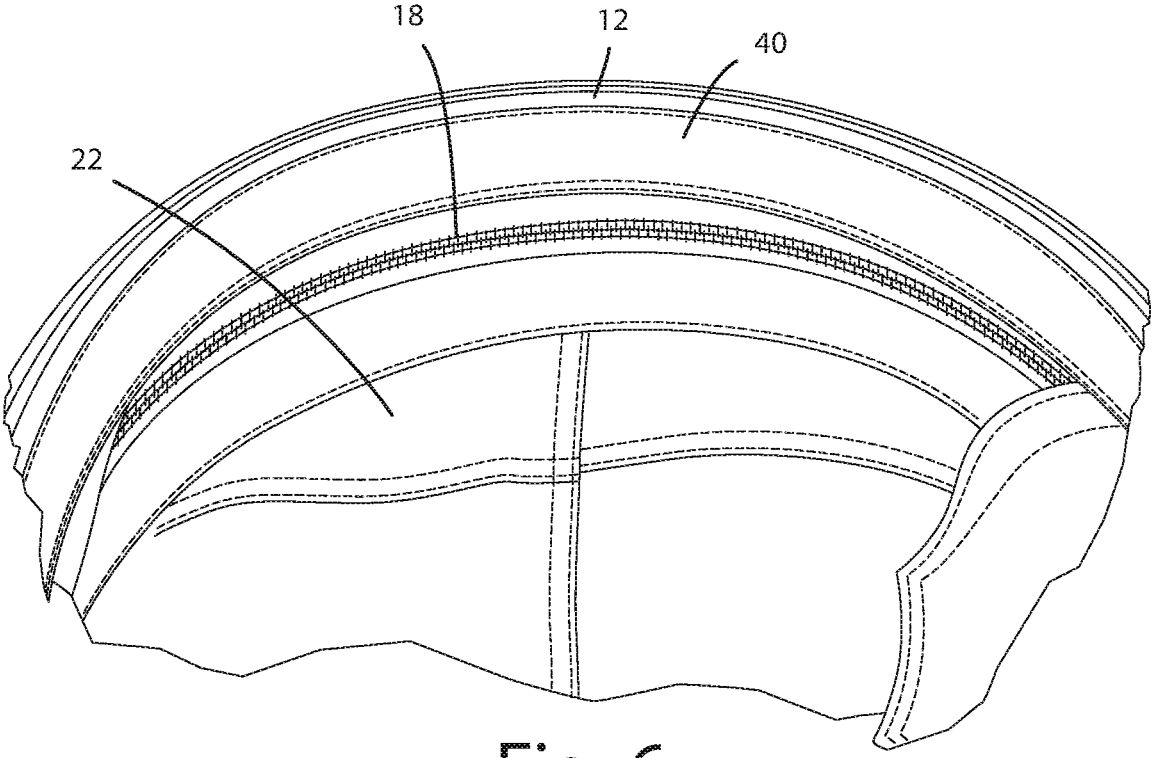
FIG. 6 of the drawings is a fragmented perspective view of a utility belt assembly, fabricated in accordance with the present invention, showing the utility belt assembly secured to an article of clothing via the securement member.
Figure 7:
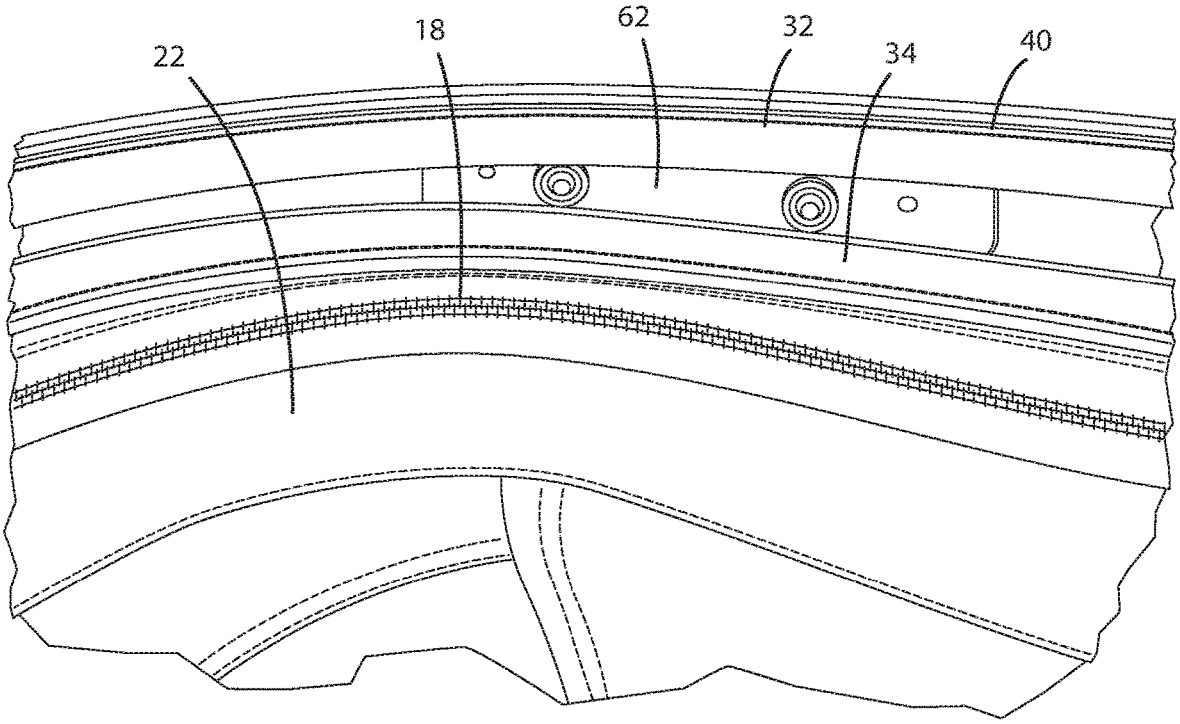
FIG. 7 of the drawings is a fragmented perspective view of a utility belt assembly, fabricated in accordance with the present invention, showing the guide member positioned within the track.
Figure 8:
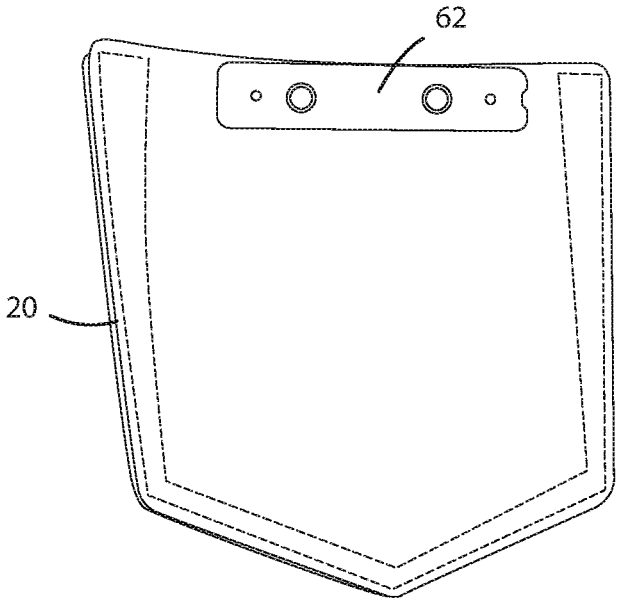
FIG. 8 of the drawings is a perspective view of an accessory member fabricated in accordance with the present invention.
Figure 9:
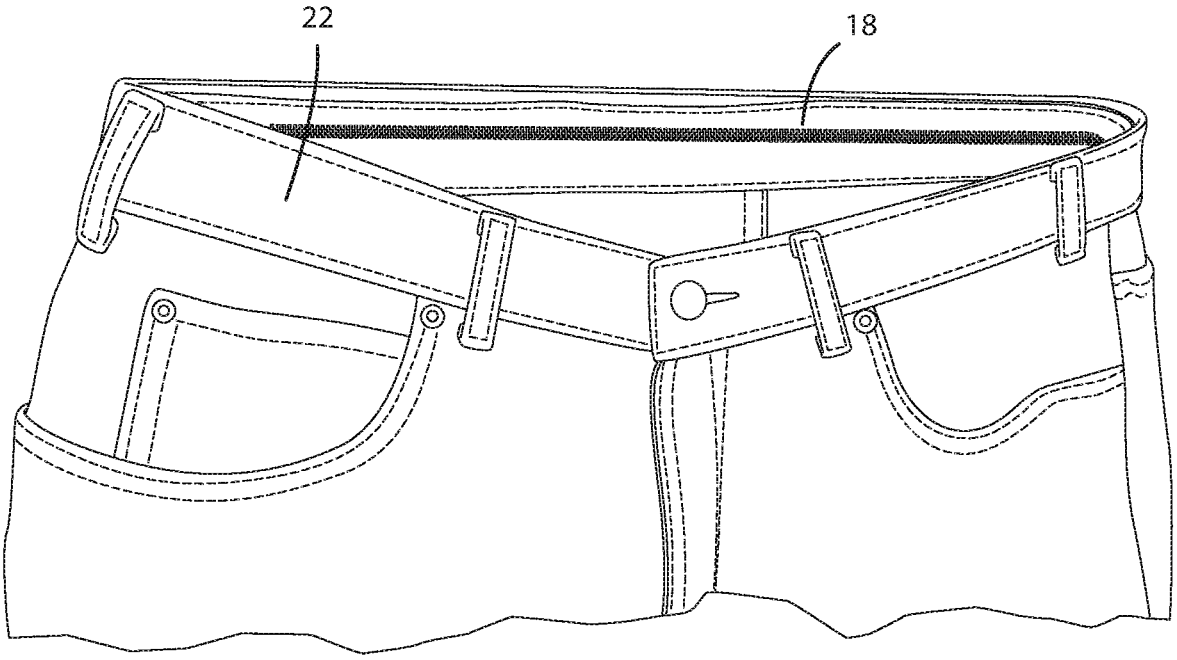
FIG. 9 of the drawings is a perspective view of an article of clothing fabricated in accordance with the present invention.
Figure 10:
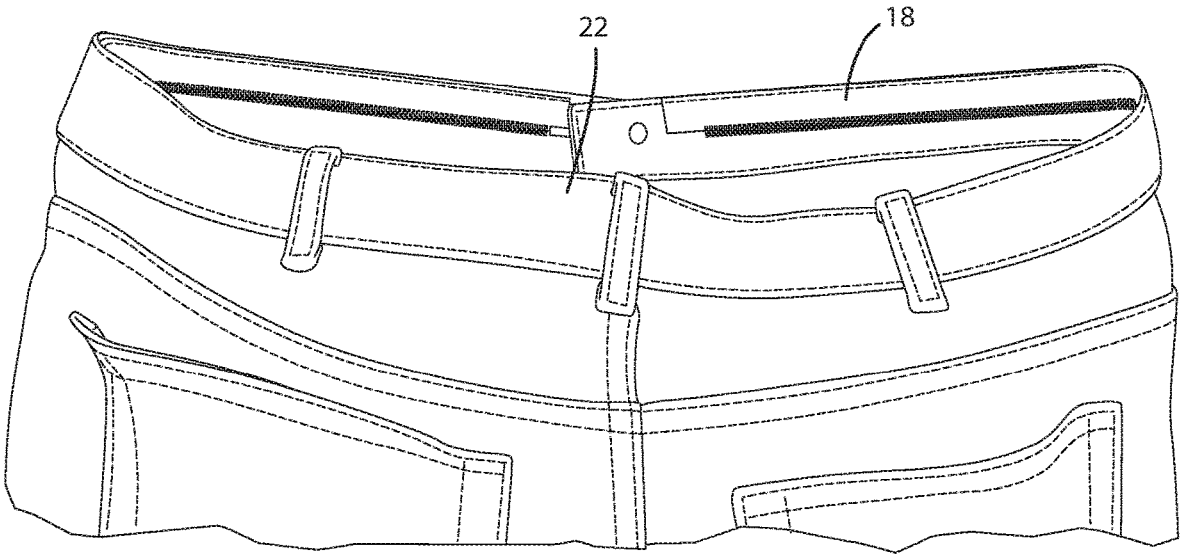
FIG. 10 of the drawings is a perspective view of an article of clothing fabricated in accordance with the present invention.

While first track 40 extends from approximately first end 24 of belt member 12 to approximately second end 26 of belt member 12, as is best shown in FIG. 6, first bracket 14 and second bracket 16 optionally comprise stop tab 64 (See FIG. 11A) for regulating displacement of accessory member 20 (not shown).

In certain embodiments of the present invention, utility belt assembly 10 comprises conductive traces 66 that facilitate provision of electricity to and/or throughout the utility belt assembly. Conductive traces 66 include, for example, conductive metal, wire, ink, paint, etcetera. In one embodiment of the present invention, a power supply is associated with the utility belt assembly. More specifically, the power supply is preferably associated with conductive traces 66 and belt member 12.

Referring now to FIGS. 11A and 11B, the present invention may also comprise a pair of utility belt assemblies 10, wherein the brackets of two utility belt assemblies face each other, and wherein the utility belt assemblies are associated with each other via a male/female securement member and/or other securement member.

In another embodiment of the present invention, the brackets may oppose each other instead of face each other, as is shown in FIGS. 11A-11F. In this embodiment, the guide member preferably is positionable over each bracket which collectively form a generally t-shape configuration.

Referring now to FIGS. 1-7 and 9-10, securement member 18 preferably contacts upper end 32 and/or lower end 34 of belt member 12. It will be understood that securement member 18 releasably associates utility belt assembly 10 with article of clothing 22. Securement member 18 preferably comprises, for example, a hook and loop fastener, a zipper, buttons, snaps, etcetera.

Referring now to FIGS. 1-4 and 7-8, accessory member 20 includes guide member 62 which is slidably positioned within first track 40. Guide member 62 is preferably releasably associated with accessory member 20 via, for example, snaps, hook and loop fasteners, buttons, zippers, selective adhesives.

In accordance with the present invention, accessory member 20 preferably includes, for example, a holster for a handgun, an ammunition magazine, a flashlight, a communication device such as a cellular phone and/or two-way radio, tools—just to name a few.

In operation, and after assembly using conventional techniques, utility belt assembly 10 is secured to article of clothing 22 via securement member 18. Article of clothing 22 is either adorned or will be adorned by a user. A user then is free to add one or more accessory members 20 to utility belt assembly 10 by sliding guide member 62 into first track 40 in a sing track configuration. It will be understood that guide member 62 and associated accessory members 20 are likewise compatible with dual track and quad track configurations. Accessory member 20 may be attached and/or secured to guide member 62 before and/or after being placed in first track 40.

The foregoing description merely explains and illustrates the invention, and the invention is not limited thereto except insofar as the appended claims are so limited, as those skilled in the art who have the disclosure before them will be able to make modifications without departing from the scope of the invention.

What is claimed and desired to be secured by Letters Patent of the United States is:

1. A utility strap assembly for use in association with an article of clothing, comprising:

a strap member, wherein the strap member includes a first end, a second end, an inner surface, an outer surface, an upper end, a lower end, a top, and a bottom;

a first bracket, wherein the first bracket is positioned on the inner surface of the strap member;

a second bracket, wherein the second bracket is positioned on the inner surface of the strap member;

wherein the first bracket and the second bracket are spaced apart from one another to define a first inwardly facing and non-enclosed track therebetween;

a securement member, wherein the securement member contacts at least one of the top and the bottom of the strap member, and wherein the securement member releasably associates the utility strap assembly with the article of clothing; and an accessory member, wherein the accessory member includes a guide member slidably positioned at least one of on and within the first inwardly facing and non-enclosed track.

2. A utility strap assembly in combination with an article of clothing, comprising:

an article of clothing adorned by a human;

a strap member, wherein the strap member includes a first end, a second end, an inner surface, an outer surface, an upper end, a lower end, a top and a bottom;

a first bracket, wherein the first bracket is positioned on the inner surface of the strap member proximate the upper end thereof;

a second bracket, wherein the second bracket is positioned on the inner surface of the strap member proximate the lower end thereof;

wherein the first bracket and the second bracket are spaced apart from one another to define a first inwardly facing and non-enclosed open track therebetween;

a securement member, wherein the securement member contacts at least one of the top and the bottom of the strap member, and wherein the securement member is releasably associated with the article of clothing; and an accessory member, wherein the accessory member includes a guide member slidably positioned at least one of on and within the first inwardly facing and non-enclosed open track.

* * * * *